United States Patent [19]

Ueda

[11] Patent Number: 4,740,094

[45] Date of Patent: Apr. 26, 1988

[54] PRINT PRESSURE CONTROL DEVICE

[75] Inventor: Hiroyuki Ueda, Yokohama, Japan

[73] Assignee: Canon Kabushiki Kaisha, Tokyo, Japan

[21] Appl. No.: 907,157

[22] Filed: Sep. 15, 1986

Related U.S. Application Data

[63] Continuation of Ser. No. 758,845, Jul. 25, 1985, abandoned, which is a continuation of Ser. No. 527,394, Aug. 29, 1983, abandoned.

[30] Foreign Application Priority Data

Dec. 27, 1982 [JP] Japan ..... 57-228455

[51] Int. Cl.[4] ..... B41J 1/30; B41J 9/38

[52] U.S. Cl. ..... 400/144.2; 101/93.03; 400/157.3; 400/166; 400/175

[58] Field of Search ..... 400/157.3, 166, 175, 400/144.2; 101/93.03

[56] References Cited

U.S. PATENT DOCUMENTS

| | | | |
|---|---|---|---|
| 1,987,276 | 1/1935 | Thompson | 400/210 |
| 3,866,533 | 2/1975 | Gilbert et al. | 101/93.03 |
| 4,103,617 | 8/1978 | O'Brien et al. | 101/93.03 |
| 4,118,129 | 10/1978 | Grundherr | 400/144.2 |
| 4,217,055 | 8/1980 | Moon | 400/166 X |
| 4,302,118 | 11/1981 | Schaefer | 400/208 |
| 4,334,791 | 6/1982 | Barozzi et al. | 400/166 |
| 4,359,287 | 11/1982 | Asahi | 400/166 |
| 4,403,874 | 9/1983 | Payne et al. | 400/124 |
| 4,558,965 | 12/1985 | Ueda | 400/225 X |

FOREIGN PATENT DOCUMENTS

| | | | |
|---|---|---|---|
| 2249538 | 5/1975 | France | 400/157.3 |
| 154193 | 12/1980 | Japan | 400/249 |
| 129191 | 10/1981 | Japan | 400/249 |
| 0084881 | 5/1982 | Japan | 400/166 |
| 1425112 | 2/1976 | United Kingdom | 400/144.2 |
| 2090030 | 6/1982 | United Kingdom | 101/93.03 |
| 2110853 | 6/1983 | United Kingdom | 400/144.2 |

OTHER PUBLICATIONS

IBM Technical Disclosure Bulletin, "Typewriter Print Impression Control", by Anderson et al., vol. 24, No. 8, Jan. 1982, pp. 4316–4317.

IBM Tech. Disc. Bul., "Composing Systems Which Incorporate Font Changing and Impression Setting From Tape or Card Input", by Hunt et al., vol. 13, No. 5, p. 1149.

Brown, "Bold and Multicolored Type", *IBM Technical Disclosure Bulletin,* vol. 16, No. 3, Aug. 1973, p. 716.

*Primary Examiner*—Paul T. Sewell

*Attorney, Agent, or Firm*—Fitzpatrick, Cella, Harper & Scinto

[57] ABSTRACT

There is disclosed a print pressure control device for a printer having at least two types of type wheels for printing characters, which gives different limits to a print pressure regulation switch depending on the type of the type wheel.

6 Claims, 2 Drawing Sheets

| IMPSW | TYPE WHEEL (WL) | AND OUTPUT |
|---|---|---|
| ORDINARY | 10 | 0 |
| ORDINARY | 12 | 0 |
| HIGH | 10 | 0 |
| HIGH | 12 | 1 |

FIG. 2

PRINT PRESSURE CONTROL DEVICE

This application is a continuation of application Ser. No. 758,845 filed July 25, 1985, now adandoned, which in turn is a continuation of U.S. Ser. No. 527,394, filed Aug. 29, 1983, now abandoned.

BACKGROUND OF THE INVENTION

1. Field of the Invention

The present invention relates to an impact printer, and more particularly to print pressure control for a printer which impacts a type to a paper with an ink ribbon being interposed between a type wheel and the paper.

Still more particularly, it relates to a print pressure control device which adjusts a print pressure depending on a type of the type wheel to attain a high quality of print.

2. Description of the Prior Art

A 10-pitch type wheel for printing ten characters per inch and a 12-pitch type wheel for printing twelve characters per inch are usually available. The 10-pitch type wheel has a relatively large type surface area while the 12-pitch type wheel has a relatively small type surface area. A printer has a print pressure setting switch so that an operator can selectively set a print pressure, apart from the type wheel. If the operator wants a high print pressure, he or she may set the switch to a high position, and if he or she wants an ordinary print pressure, he or she may set the switch to an ordinary position.

However, if the print pressure is set to high when the 12-pitch type wheel is loaded, the high print pressure is applied in spite of the small type surface area and the paper is embossed. As a result, a high quality of print is not attained.

SUMMARY OF THE INVENTION

It is an object of the present invention to provide a print pressure control device which resolves the above problem and attains the high quality of print.

BRIEF DESCRIPTION OF THE DRAWINGS

FIG. 2 is a combination logic chart for explaining the operation of FIG. 1.

DETAILED DESCRIPTION OF PREFERRED EMBODIMENT

Figure 1:
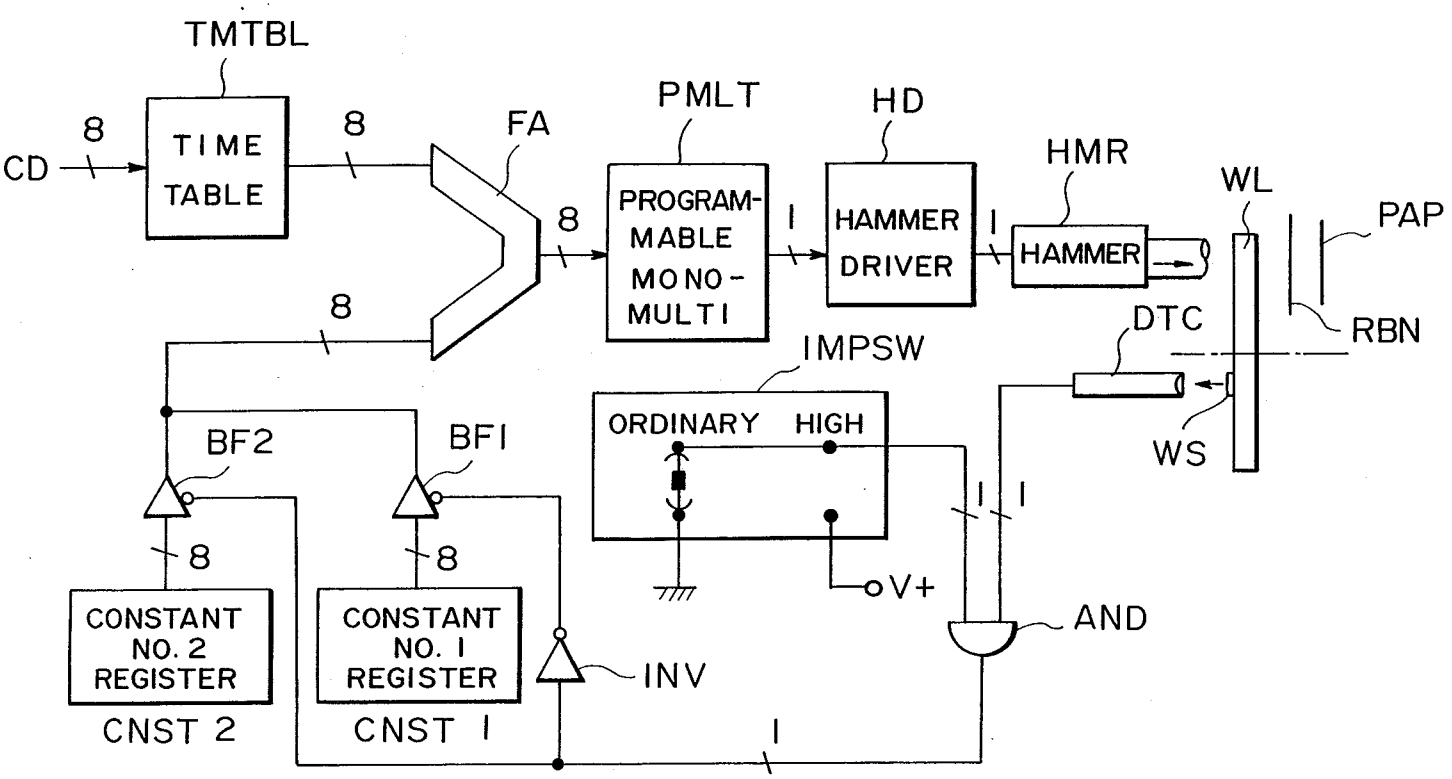
FIG. 1 is a block diagram of a main portion of the present invention.

FIG. 1 shows a main portion of the present invention, in which TMTBL denotes a time table which contains a plurality of hammer drive times, PMLT denotes a programmable monostable multivibrator, HD denotes a hammer driver, HMR denotes a print hammer, WL denotes a type wheel, RBN denotes a print ribbon, PAP denotes a print paper, WS denotes a signal generating means attached to the type wheel WL to generate a signal indicating a type of the type wheel, DTC denotes a detection means for detecting the signal from the signal generating means WS, IMPSW denotes a manual switch for selectively setting the print pressure, AND denotes an AND gate, INV denotes an inverter, CNST1 and CNST2 denote constant resisters, and BF1 and BF2 denote tristate buffers. The time table TMTBL, the programmable monostable multivibrator PMLT and the manual print pressure selection switch IMPSW are disclosed in British Pat. Nos. 1425112, 1502956, and British Laid-Open Applications Nos. 2087115 and 2110853.

A plurality of type wheels WL are provided. When a 10-pitch type wheel is mounted, the detection means DTC supplies a logical "0" signal to the AND gate, and when a 12-pitch type wheel is mounted, it supplies a logical "1" signal. The print pressure selection switch IMPSW sends a logical "0" signal to the AND gate when it is set to an "ordinary" position, and sends a logical "1" signal when it is set to a "high" position. The time table TMTBL is accessed by character information CD to be printed and the selected hammer drive time is applied to one input terminal of a full adder FA. The output of the time table TMTBL also varies depending on the "ordinary" or "high" position of the print pressure selection switch and a font pressure selection switch and a font of the type wheel WL (Pica, Elite and etc.), but a construction therefor is omitted here because it is disclosed in the British Laid-Open Application No. 2110853.

Application to the other input terminal of the full adder FA is the output of either the buffer BF1 or the buffer BF2. The constant registers CNST1 and CNST2 are connected to the buffers BF1 and BF2, respectively. The AND gate produces the outputs shown in FIG. 2 depending on the combinations of the "ordinary" and "high" positions of the manual switch IMPSW and the 10-pitch and 12-pitch of the type wheel WL. The output of the AND gate is "0" when the manual switch IMPSW is "ordinary" regardless of the 10-pitch and 12-pitch of the type wheel WL. The "0" output of the AND gate is inverted by the inverter INV to "1" so that the output of the buffer BF1 is applied to the other input terminal of the full adder FA. Thus, a first constant stored in the constant register CNST1 and the output of the time table TMTBL are summed by the full adder FA and the print operation is effected in accordance with the sum output in the same manner as that described the above British Patents and Applications.

If the manual switch IMPSW is in the "high" position, the output of the AND gate is "0" for the 10-pitch type wheel and "1" for the 12-pitch type wheel as shown in FIG. 2. Thus, for the 10-pitch type wheel, the constant register CNST1 is selected and the first constant therein is sent to the full adder FA. On the other hand, the time table TMTBL produces a higher value than that produced when the manual switch IMPSW is in the "normal" position in the same manner as that described in the above patents and applications. Thus, the printing is effected at a higher pressure than that in the "normal" position.

When the 12-pitch type wheel is mounted and the manual switch IMPSW is in the "high" position, the output of the AND gate is "1" as shown in FIG. 2. Thus, the output of the inverter is "0" and the output of the constant register CNST1 is not supplied to the other input terminal of the full adder FA but the output of the constant register CNST2 is applied to the other input terminal of the full adder FA. It is important to note that a second constant stored in the second constant register CNST2 is smaller than the first constant stored in the first constant register CNST1. Accordingly, the output of the full adder FA is smaller than the output produced when the manual switch IMPSW is in the "high" position and the 10-pitch type wheel is mounted.

As a result, when the 12-pitch type wheel is mounted and the manual switch IMPSW is in the "high" position, the print pressure is lower than that for the 10-pitch type wheel.

In this manner, the problem of embossing of the paper encountered in the prior art printer is resolved and a satisfactory printer is provided.

While the illustrated embodiment uses the "ordinary" and "high" positions of the manual switch IMPSW and the 10-pitch and 12-pitch type wheels, additional switch positions and/or additional type wheels may be used.

What I claim is:

1. A printer comprising:

at least first and second kinds of type wheels selectively loadable on the printer for printing a number of characters, the print pitch of the first kind of type wheel being finer than that of the second kind of type wheel;

detection means for detecting the kind of said type wheel loaded on the printer;

setting means for manually selecting a print pressure setting for said loaded type wheel from between at least normal and high print pressure settings;

drive signal generating means for generating a normal drive signal upon manual selection of the normal print pressure setting and a high drive signal upon manual selection of the high print pressure setting, the normal and high drive signals being the same for both the first and second kinds of type wheels; and control means for adjusting at least one of the normal drive signal and the high drive signal in response to both the print pressure set by said setting means and the kind of type wheel detected by said detecting means, wherein the difference between the normal print pressure and the high print pressure adjusted for the first kind of type wheel is different from the difference between the normal print pressure and the high print pressure adjusted for the second kind of type wheel.

2. A printer according to claim 1, wherein:

said drive signal generating means includes a table for normal and high specified drive signals, a first memory for storing a first constant and an adder for adding the first constant to the normal and high specified drive signals to produce the normal and high drive signals, respectively; and said control means includes a second memory for storing a second constant smaller than the first constant and a logic circuit responsive to detection of the first kind of said type wheel and the high print pressure setting for replacing the first constant with the second constant in said adder to produce the reduced high drive signal.

3. A printer according to claim 1, wherein the normal print level adjusted by said control means is the same for both the first and second kind of type wheel.

4. A printer comprising:

means for selectively loading one of at least two kinds of type wheels each having signal generating means for generating a signal representing the kind of the type wheel;

detection means for detecting the signal generated by said signal generating means of a loaded type wheel;

setting means for manually setting a print pressure for the type wheel from between at least two pressure levels;

drive generating means for generating a type drive signal to print a character with a print pressure corresponding to the loaded type wheel;

time table means for setting time information in accordance with the kind of loaded type wheel;

a plurality of memories, each storing a constant value associated with selected ones of the at least two kinds of type wheels; and control means responsive to both the output from said detection means and to said setting means for controlling said drive generating means to generate the time drive signal in accordance with a combination of corresponding ones of the constant values and corresponding time information, wherein the difference between the two pressure levels for a first kind of type wheel is different from the difference between the two pressure levels for a second kind of type wheel.

5. A printer according to claim 4, wherein said control means controls said drive signal generating means to generate a lower print pressure.

6. A printer according to claim 4, wherein one of the two pressure levels is the same for both the first and second kind of type wheels.

* * * * *